US005706594A

United States Patent [19]

Lin

[11] Patent Number: 5,706,594

[45] Date of Patent: Jan. 13, 1998

[54] ROTATIONAL COLOR-LIQUID DECORATION

[76] Inventor: Rich Lin, No. 185, Dah Guan Road, Section 2, Taipei Hsien, Taiwan

[21] Appl. No.: 567,245

[22] Filed: Dec. 5, 1995

[51] Int. Cl.[6] ..... G09F 19/00

[52] U.S. Cl. ..... 40/406; 40/431; 446/267; 446/485

[58] Field of Search ..... 40/406, 407, 409, 40/431; 446/267, 485

[56] References Cited

U.S. PATENT DOCUMENTS

| | | | |
|---|---|---|---|
| 616,508 | 12/1898 | Vedder | 40/409 |
| 3,444,636 | 5/1969 | Belokin, Jr. | 40/409 |
| 3,531,635 | 9/1970 | Hancock | 40/407 X |
| 3,738,036 | 6/1973 | Landsinger et al. | 40/406 |
| 3,964,194 | 6/1976 | Gugeler | 40/406 |
| 4,507,087 | 3/1985 | Stevenson | 40/406 X |
| 4,686,784 | 8/1987 | Smithies | 40/406 |
| 4,939,859 | 7/1990 | Bradt | 40/406 |
| 4,944,969 | 7/1990 | Usui | 40/409 X |
| 5,301,444 | 4/1994 | Horiuchi | 40/406 X |

FOREIGN PATENT DOCUMENTS

| | | | |
|---|---|---|---|
| 617395 | 9/1994 | European Pat. Off. | 40/406 |

*Primary Examiner*—Anthony Knight
*Assistant Examiner*—Andrea Chop
*Attorney, Agent, or Firm*—Bacon & Thomas

[57] ABSTRACT

A rotational color-liquid decoration including a base is set forth and a disk rotatably disposed on the base. The disk defines a closed space which is partitioned into multiple compartments in parallel with a surface of the disk. Each of these parallel compartments has a clear central area and an outer peripheral zone surrounding the central area. Colored liquid is sealed in each compartment to be carried by liquid collection units in the peripheral zone to a higher position when the disk is rotated. When the colored liquid in respective liquid collection unit reachs a certain position, it drips from an outlet of the liquid collection unit and passes the clear central area to be flattened into changing patterns in varying colors, serving as a dynamic decoration. A clock may be attached to a back side of the clear central area of the disk to enable the decoration to additionally function as a timepiece.

5 Claims, 6 Drawing Sheets

ROTATIONAL COLOR-LIQUID DECORATION

BACKGROUND OF THE INVENTION

There are various kinds of liquid decorations commercially available on the market to respectively provide a different decorative effect. Among these decorations, there is a so-called "color box" as shown in FIG. 1, which uses laminated layers to provide two closed and clear spaces to contain differently colored liquid therein. Each space is provided at upper and lower parts with liquid storing areas as well as a middle outlet and two side inlets. Each time the "color box" is turned upside down, the colored liquid in respective space starts dripping down and is flattened and extended in the space with the gradually reduced clearance between the laminated layers. The colored liquid of individual spaces overlaps with each other in the course of dripping down and forms a third color, giving the "color box" diversified and changing patterns in the closed spaces. This "color box" provides a dynamic decorative effect and was widely welcomed by consumers. A disadvantage existed in this "color box" in that it has to be turned upside down by a user whenever the colored liquid completely drips down to a lower part of the box so as to show the next dynamic colorful pattern. This of course causes some troubles. On the other hand, the monotonous design of the "color box" gradually loses its appeal to the consumers.

It is therefore a part of the present invention to develop an improved rotational color-liquid decoration for increasing the added value of the conventional liquid decorations and thereby prolonging the life of such products.

SUMMARY OF THE INVENTION

A primary object of the present invention is to provide a rotational liquid color decoration having a rotatable disk as a major portion thereof. Liquid of different colors is sealed inside the disk so that liquid is carried to an upper position by the rotation of the disk and drips down to pass a central portion of the disk while the disk keeps rotating. The continuous rotation of the disk causes the dripping colored liquid to form continuous and changing patterns in the disk.

Another object of the present invention is to provide a rotational color-liquid decoration having a rotatable disk as a major portion thereof. In addition to the colored liquid carried by the rotating disk for creating changing and colorful patterns, a clock is attached to a back side of the disk to provide the decoration with an additional function.

The rotational color-liquid decoration according to the present invention mainly includes a base and a disk disposed on the base. The disk can be driven to rotation by means of a motor and a set of rubber rollers supporting it. The disk defines a closed space which is further partitioned into multiple narrow and parallel compartments into which colored liquid is sealed. Each of the compartments has a clear central area and an outer peripheral zone surrounding the central area. A plurality of liquid collection units are sequentially arranged around the peripheral zone to carry the colored liquid to a higher position when the disk is rotated. When the colored liquid is carried to a certain height, it empties from an outlet formed on each liquid collection unit and drips down therefrom. The dripped colored liquid passes the central area and be flattened therein to form changing patterns in varying colors, providing a dynamic decoration. A clock may be attached to a back side of the clear central area so that the decoration may additionally function as a timepiece.

DETAILED DESCRIPTION OF THE PREFERRED EMBODIMENTS

Figure 1:
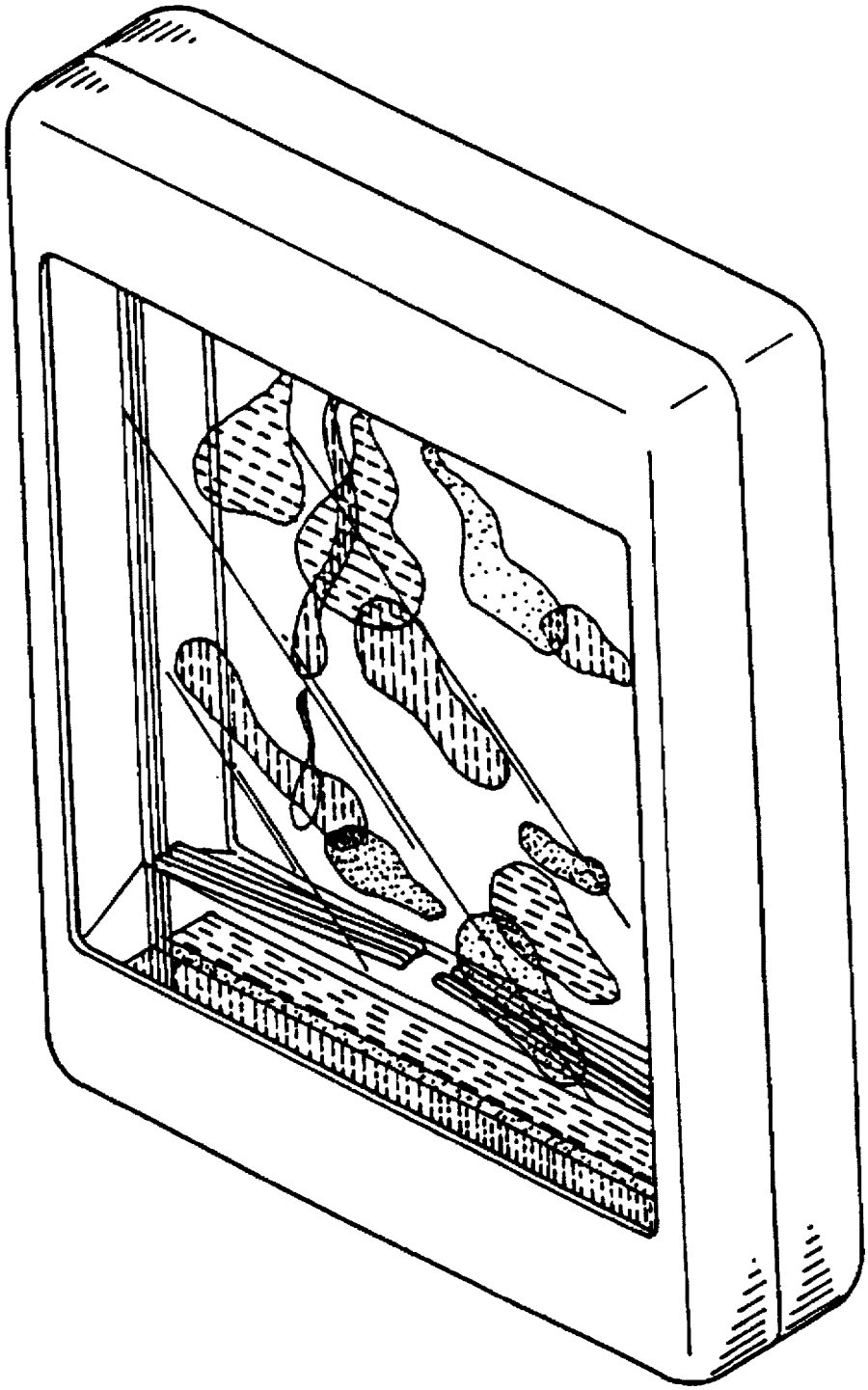
FIG 1 PRIOR ART
FIG. 1 is a perspective view of a conventional color-liquid decoration which is usually referred to as a "color box"
Figure 2:
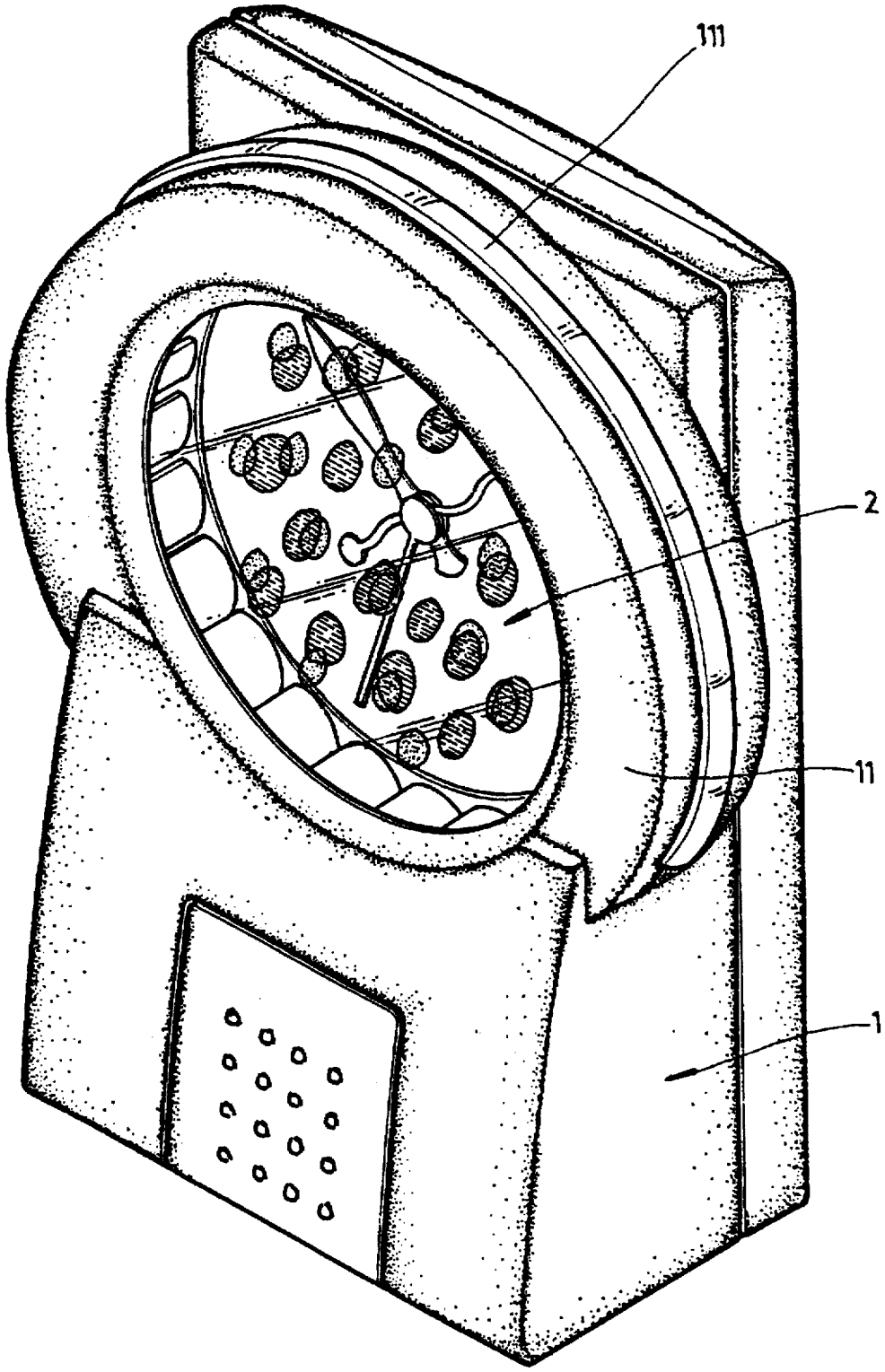
FIG. 2 is a perspective showing a preferred embodiment of the rotational color-liquid decoration according to the present invention.
Figure 3:
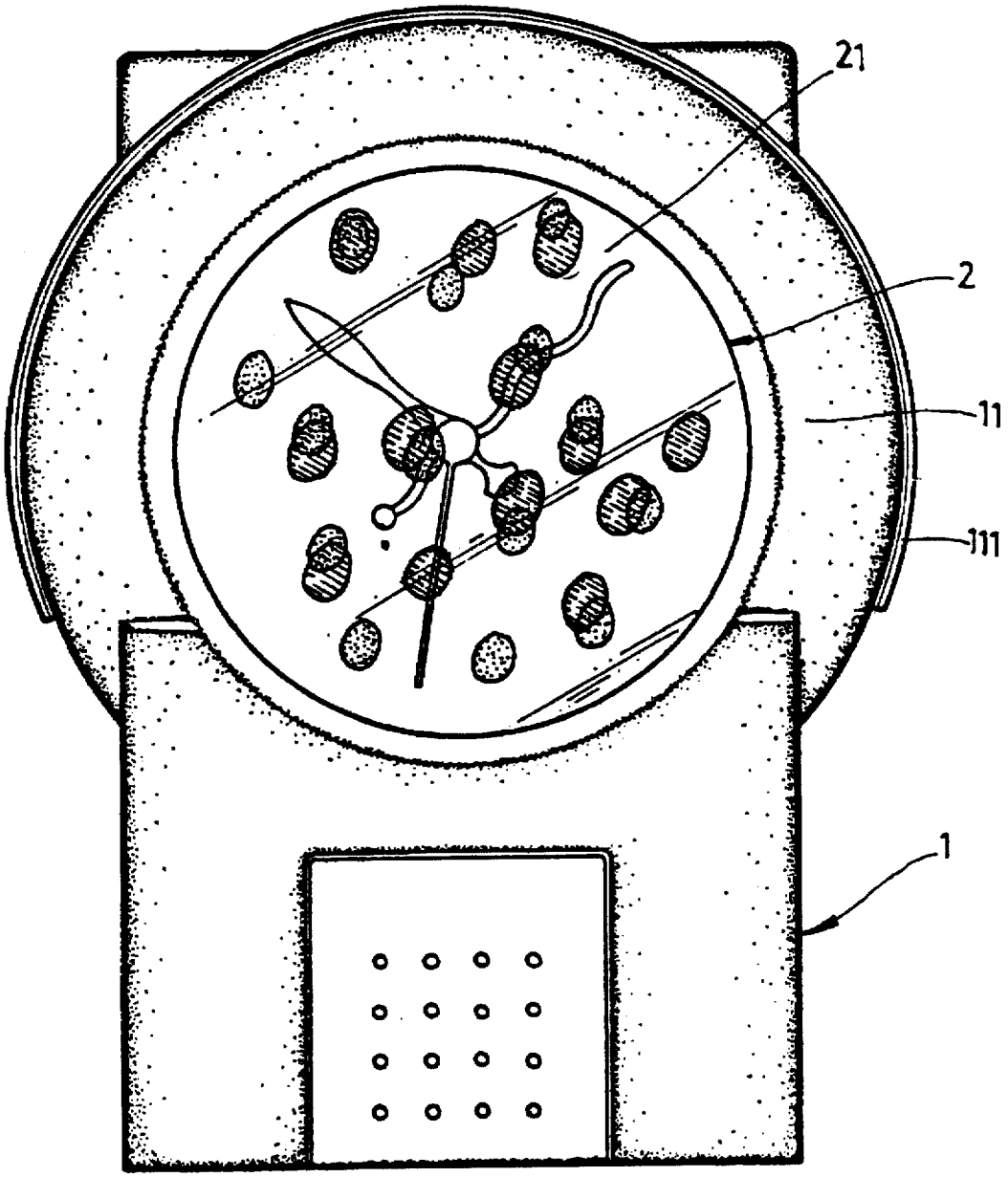
FIG. 3 is a front elevational view of the present invention shown in FIG. 2.
Figure 4:
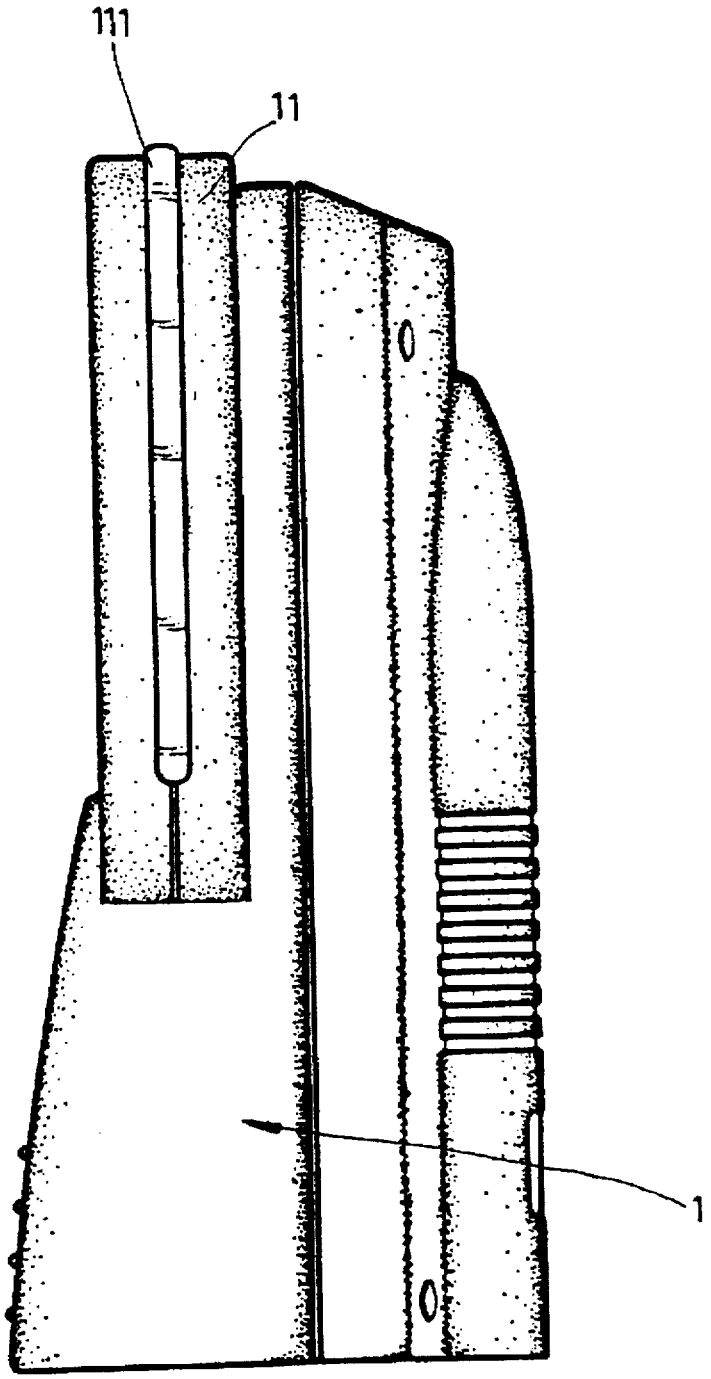
FIG. 4 is a side elevational view of the present invention shown in FIG. 2.

The present invention as shown in FIGS. 2, 3 and 4, mainly includes two portions, namely, a base 1 and a rotational disk 2.

The base 1 is used to accommodate a driving mechanism therein for turning the disk 2 and further includes an integrally formed casing 11. The driving mechanism can be powered either by batteries or by connecting to an external AC power source.

Figure 5:
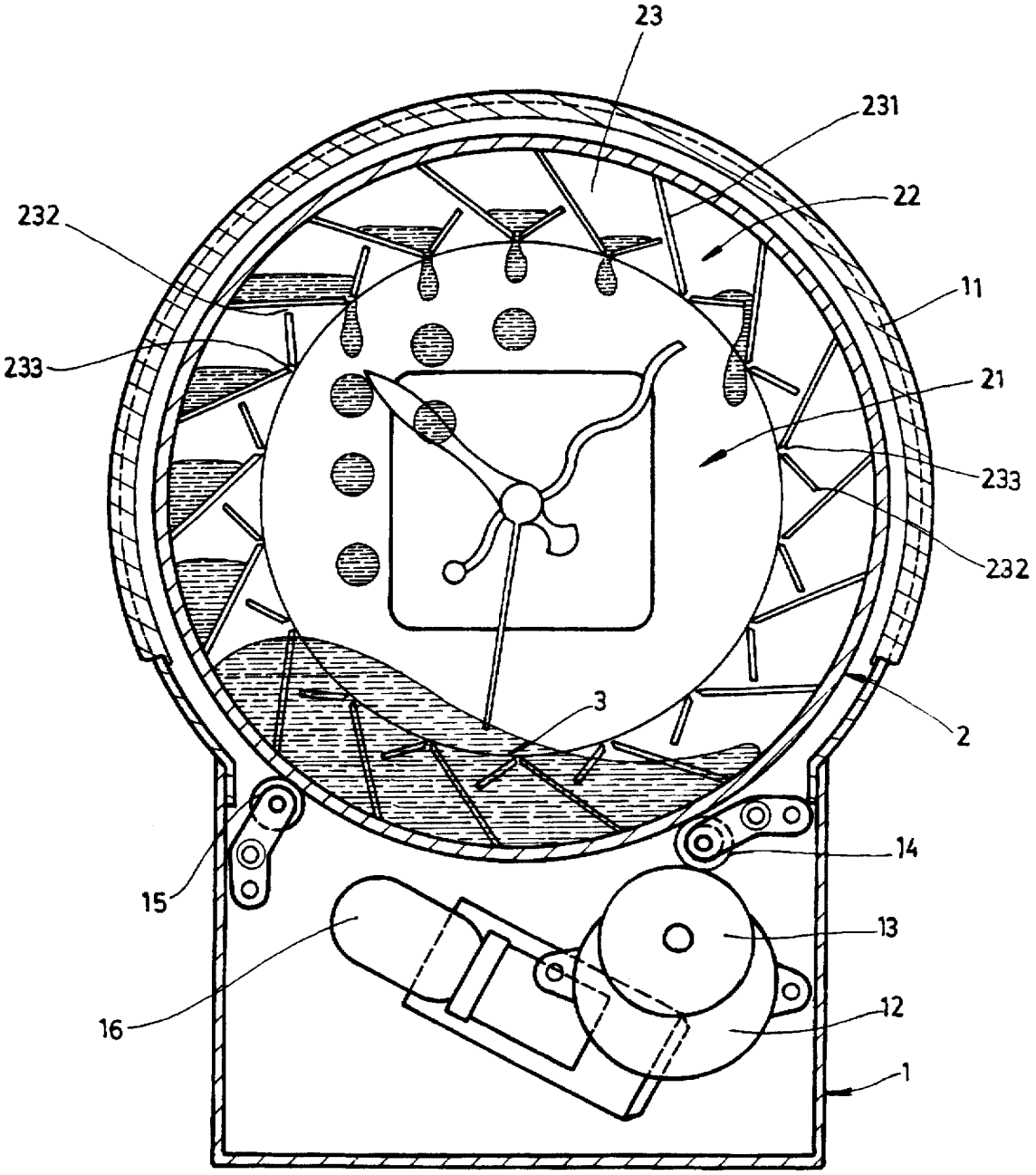
FIG. 5 is a front sectional view of the present invention shown in FIG. 2.
Figure 6:
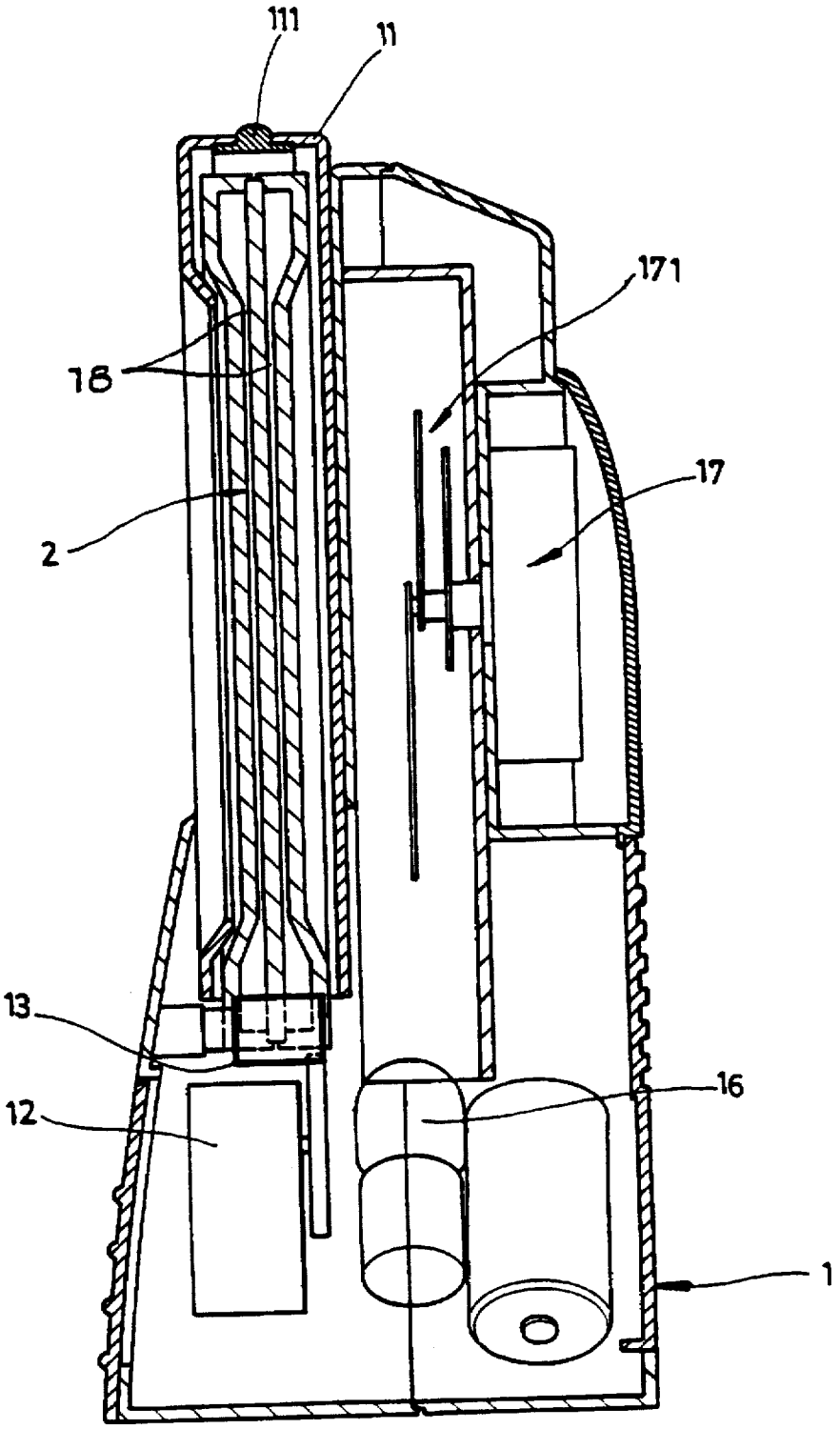
FIG. 6 is a side sectional view of the present invention shown in FIG. 2.

The driving mechanism, shown in FIGS. 5 and 6, is accommodated in the base 1 and includes a motor 12 which drives a set of rubber rollers 13, 15 in rotation. An idler 15 is fixed in the base 1 at a predetermined position opposite to the rubber roller 13. The idler 15 and the rubber roller 14 together support the rotational disk 2 above them, so that the rotational disk 2 vertically stands in a stable manner.

The rotational disk 2 is located below a space generally defined by the casing 11. To enable the rotational disk 2 to stably rotate inside the casing 11 in a normally vertical position, stabilizing means, such as a protuberance and a groove serving as a rail, can be correspondingly provided on an inner peripheral surface of the casing 11 and an outer peripheral surface of the disk 2, respectively. With a slight and proper frictional contact of the protuberance with the groove, the disk 2 is permitted to rotate in a vertical and stable manner inside the casing 11. Since this is in the prior art, it is not described in any detail herein.

The rotational disk 2 is so structured that it is generally a closed body defining a space therein. The space inside the disk 2 is further partitioned into two or more compartments 18, each extending in parallel with a surface of the disk 2. In an embodiment as shown in FIGS. 2 through 6, there are two such parallel compartments 18 inside the disk 2. Each of the compartments 18 inside the disk 2 includes a clear central area 21 and an outer peripheral zone 22. A plurality of liquid-collection units 23 are sequentially arranged in and around the outer peripheral zone 22. Each of the liquid-collection units 23 consists of two angularly positioned partitions 231 such that an inlet 232 is left between each two of the units 23 and an outlet 233 is formed between two partitions 231 of each unit 23 adjacent to an outer periphery of the central area 21.

When the motor 12 is started and drives the rubber rollers 13 and 14 in rotation the disk 2 is thereby brought into rotation, too. Colored liquid 3 is sealed in each compartment in the disk 2 and gives the disk some weight to permit the same to rotate in a substantially vertical position relative to the base 1. The colored liquid 3 in each compartment of the disk 2 is initially collected in the liquid-collection units 23 at a lower portion of the disk 2. Following rotation of the disk 2, the colored liquid 3 in the liquid-collection units 23 is carried to a higher position in the decoration device. When the colored liquid 3 in the liquid-collection units 23, is carried to a position with the liquid 3 having a level higher than the outlet 233 of the liquid-collection unit 23, the colored liquid 3 flows out of the liquid-collection unit 23 through the outlet 233. The liquid 3 is a composite of water, clear oil, and colors and can therefore fall in a drip-drop manner. The angle contained between two partitions 231 in one unit 23 and the size of the outlets 233 are specially designed so that the colored liquid 3 can drip in a moving course of the disk to cover most parts of the central area 21 of the disk 2.

Colored liquid 3 dripping and flowing through different compartments formed inside the disk 2 is flattened in the respective compartment to form varied patterns. In addition, the visually overlapped colored liquid 3 in different colors simultaneously passing the clear central area 21 generates a third color (when there are two parallel compartments formed in the disk 2). The continuous rotation of the disk 2 permits continuous and changing colorful patterns to form in a completely automatic manner. When the colored liquid 3 falls and reaches a bottom position of the rotational disk 2, it is again collected in the liquid-collection units 23 and is carried to a higher position to complete a cycle of the operation of the decoration. The cyclic operation of the decoration repeats and changes and colorful patterns keep forming in the central area 21 of the disk 2.

To permit the color-liquid 3 to produce more changing patterns, each compartment formed in the space defined by the disk 2 can be designed to have varying depth so that liquid 3 passing therethrough shall be flattened to a different extent at different positions, thereby producing different patterns from top to bottom. Meanwhile, the visually overlapped color-liquid 3 in different compartments having different depths further produces a third color that varies with position as the overlap forms. In the event a compartment for the color-liquid 3 to pass is designed to have varying depth from top to bottom or from one side to the other side, or to have some curvature at different positions, only a single compartment in the space defined by the disk 2 can produce many changing beautiful patterns in the rotational disk 2.

What is to be noted is the proportion of the central area 21 to the outer peripheral zone 22 in area and/or width and all can be differently designed to achieve visually different and dynamic patterns from the dripping colored liquid 3. The only common requirement in designing different embodiments of the present invention is that the outer periphery of the disk 2 shall have a surface smooth enough to cooperate with the rubber rollers 14 to produce adequate friction between them to enable the disk 2 to rotate stably.

In another embodiment of the present invention, a clock 17 is attached to a back side of the casing 11 with a dial 171 of the clock 17 immediately behind the central area 21 of the disk 2. Since the central area 21 is formed of completely transparent material to show the changing patterns produced by the colored liquid 3, it also allows the dial 171 to clearly show the time through the central area 21. To provide a complete and beautiful appearance of the decoration, the casing 11 may be partially extended to house all parts of the clock 17 therein. A lighting means, such as a bulb 16, may be mounted in the bottom portion of the base 1 at a proper position to light the dial 171 so that it can be clearly seen even at night or in a dark place. The light from the lighting means may also enhance the color effect of the decoration. A colored transparent belt 111 may be provided around the casing 11 to permit the light from the lighting means to emit therefrom, allowing the decoration to additionally function as a night-light.

What is claimed is:

1. A rotational liquid color decoration device comprising:

a base;

a motor mechanism including a drive roller, supporting rollers, and an idler structure, said motor mechanism being disposed within said base;

a disk including a plurality of clear, connected, parallel partitions defining spaces therebetween, each of said spaces including a central area and an outer peripheral zone, each of said spaces containing a colored liquid at a first lower position, and said disk being rotated by said motor mechanism; and a plurality of liquid collection units disposed in said outer peripheral zone, each of said liquid collection units comprising two partition members together forming an angle therebetween for carrying said liquids, an outlet between said two members for dispensing said liquids between each of said partitions at a second higher position of said disk structure, the outlet located at an apex of the angle and an inlet located between each of said liquid collection units for filling said liquid collection units with said liquids at said first lower position of said disk;

wherein said colored liquid drips from said outlet at said second position down between said parallel partitions as said disk is rotated by said motor mechanism to provide changing color patterns in said spaces.

2. The rotational liquid color decoration device according to claim 1, wherein at least three of said parallel partitions define at least two of said spaces.

3. The rotational liquid color decoration device according to claim 2, further comprising a clock disposed at a side of said disk, wherein said clock is viewed through said central areas.

4. The rotational liquid color decoration device according to claim 3, further comprising a lighting structure disposed at a lower portion of said base, wherein said clock is viewed in darkened areas.

5. The rotational liquid color decoration device according to claim 1, further comprising a lighting structure disposed at a lower portion of said base, wherein said disk is viewed in darkened areas.

* * * * *